US012343839B2

(12) United States Patent
Stallegger

(10) Patent No.: US 12,343,839 B2
(45) Date of Patent: Jul. 1, 2025

(54) KNIFE SHARPENING DEVICE WITH 1-POINT BEARING

(71) Applicant: Harald Stallegger, Pöndorf (AT)

(72) Inventor: Harald Stallegger, Pöndorf (AT)

( * ) Notice: Subject to any disclaimer, the term of this patent is extended or adjusted under 35 U.S.C. 154(b) by 509 days.

(21) Appl. No.: 17/709,872

(22) Filed: Mar. 31, 2022

(65) Prior Publication Data

US 2022/0314389 A1 Oct. 6, 2022

(30) Foreign Application Priority Data

Apr. 1, 2021 (DE) ..... 10 2021 001 726.9

(51) Int. Cl.
*B24B 3/54* (2006.01)

(52) U.S. Cl.
CPC ..... *B24B 3/54* (2013.01)

(58) Field of Classification Search
None
See application file for complete search history.

(56) References Cited

U.S. PATENT DOCUMENTS 2,885,836 A * 5/1959 Robitaille ..... B24D 15/081 451/555
3,322,002 A * 5/1967 Silberman ..... B24B 3/54 76/89.1
4,550,632 A * 11/1985 Inman ..... B24D 15/08 76/86
5,440,953 A * 8/1995 Gangelhoff ..... B24D 15/081 76/86
11,192,217 B2 * 12/2021 Zachariasen ..... B24D 15/081
2015/0151408 A1 * 6/2015 Jhones ..... B24D 15/08 29/434
2020/0368877 A1 11/2020 Sirotich
2021/0031325 A1 * 2/2021 Stallegger ..... B24B 3/54
2022/0161393 A1 * 5/2022 Eklund ..... B24D 15/04

FOREIGN PATENT DOCUMENTS

DE 10 2007 061 535 B4 3/2017
DE 10 2018 112 563 A1 8/2019
DE 10 2019 102 200 A1 8/2019
GB 191266 A 1/1923
WO 2013/149269 A1 10/2013

* cited by examiner

*Primary Examiner* — Bryan R Muller
*Assistant Examiner* — Dana Lee Poon
(74) *Attorney, Agent, or Firm* — Thompson Coburn LLP

(57) ABSTRACT

A knife sharpening device has two sharpening rods which are pivotally arranged on a base and arranged in a V-shape relative to one another to allow insertion of a knife therebetween. The sharpening rods each comprise at least one sharpening insert. The sharpening rods are held in a rest position at a predetermined distance from one another in their V-shaped arrangement by the force of a respective spring. The sharpening rods are spreadable apart in a sharpening position by insertion of the knife upon contact of the knife with the sharpening inserts against the force of the spring. The sharpening rods are held by a single holding point on the base.

27 Claims, 7 Drawing Sheets

Figure 1:
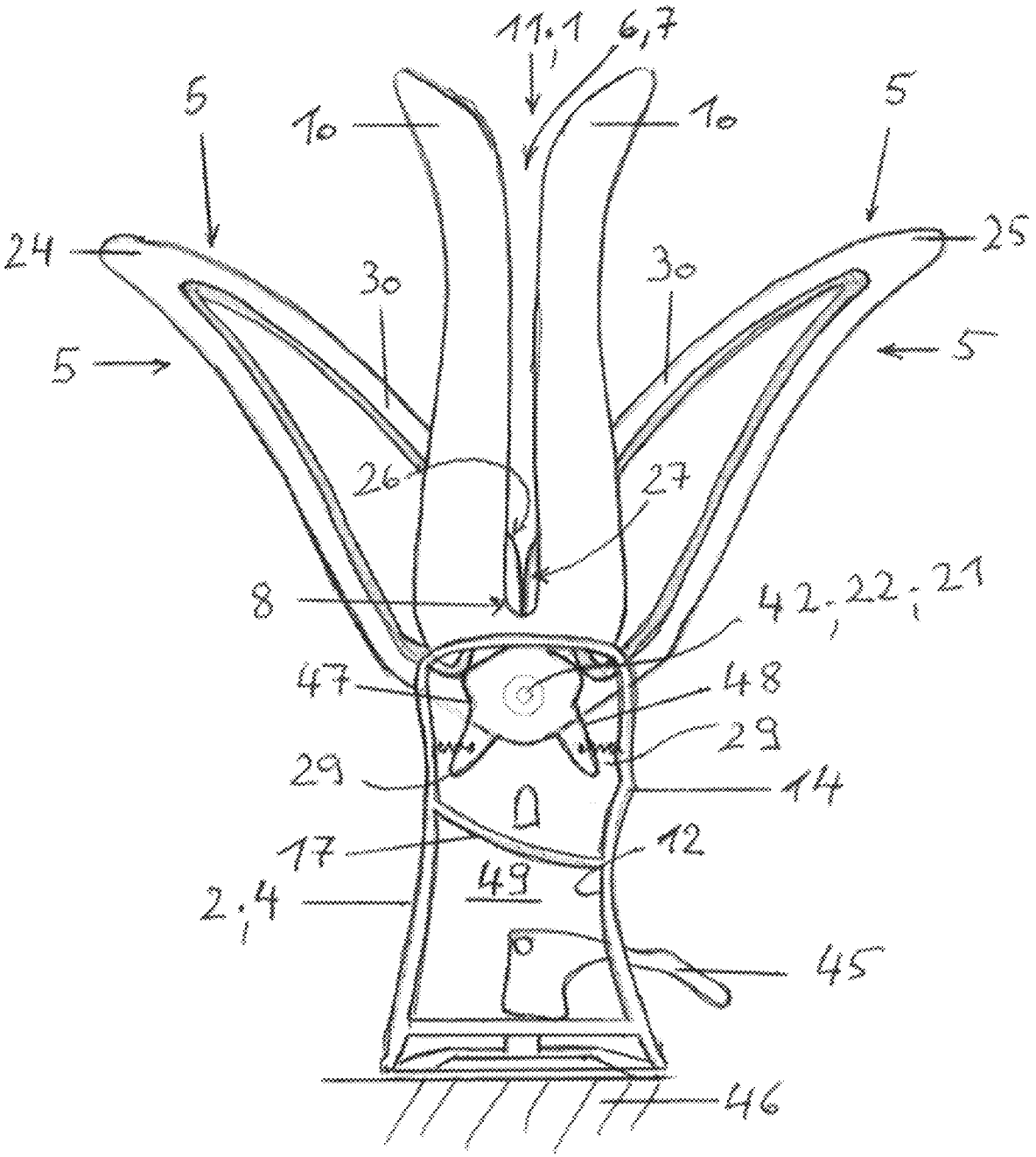

54
24
25
24
25
10
4
4
2
2
45
46

KNIFE SHARPENING DEVICE WITH 1-POINT BEARING

RELATED APPLICATION DATA

This application claims priority benefit to German patent application ser. no. 10 2021 001 726.9, filed Apr. 1, 2021, the disclosure of which is incorporated by reference herein.

The invention relates to a knife sharpening device with at least two sharpening rods which are pivotably arranged on a base according to the features of the preamble of claim 1.

A knife sharpening device is known from DE 10 2007 061 535 B4, which has a holder on which two intersecting sharpening rods are rotatably mounted and are loaded towards one another by means of a spring pressure. The knife sharpening device has a knife insertion slot which is open at one end and extends in the direction of a crossing point of the sharpening rods.

In this way, the sharpening rods are pressed apart against the restoring force of the spring from a rest position, in which the sharpening rods assume a crossing angle, into a sharpening position. The sharpening rods are lockable in a sharpening position for honing the knife with a locking device in which the crossing angle of the sharpening rods is greater than the crossing angle in the rest position.

The rest position corresponds to a state of non-use. The sharpening position, on the other hand, denotes a position of the knife sharpening device in which the blade of the knife with or without serration can be sharpened and/or honed and/or polished.

Known knife sharpening devices require a plurality of fastening means for each sharpening rod for arranging the sharpening rods on the support plate of the knife sharpening device. If excessive restoring force is applied to the blade of the knife when it is inserted into the slot in the plate of the knife sharpening device, or if the blade of the knife being sharpened is tilted when it is inserted into the plate, material will be scraped from the plate.

Likewise, it can lead to damage to the blade of the knife to be sharpened.

The scraped or sharpened material chips can stick to the knife sharpening device. This can cause the chips to come into unwanted contact with the sharpening inserts or the blade of the knife. The material chips can also get between the knife and the sharpening insert during a subsequent sharpening process and prevent optimum sharpening of the knife.

In other known knife sharpening devices, contaminants located on the knife blade can reach the springs and/or the sharpening inserts and prevent an optimal sharpening process.

Other known knife sharpening devices prove to be disadvantageous because the sharpening inserts and/or the springs of the knife sharpening devices are in the area of influence of the user's hands, which can cause injuries to the user's hands.

Other known knife sharpening devices comprise a large number of individual parts, due to which no small amount of technical expertise is required to assemble and replace spare parts. The large number of individual technical parts can lead to damage to the knife sharpening device during assembly by the user.

The large number of individual technical parts also increases the manufacturing, repair and maintenance costs of the knife sharpening device.

A non-variable spring force of many known knife sharpening devices further leads to the fact that such devices cannot be used for knife blades of different types and grades.

Objects of the Invention

The present invention therefore sets itself the object of providing a knife sharpening device with which the blades of knives of different types, grades and functions can be resharpened and/or honed and/or polished with a single knife sharpening device.

A knife sharpening device is to be provided in which, in particular, the springs and the sharpening inserts are arranged in such a way that the risk of injury to the user, if not completely avoided, can be nearly eliminated.

It is further intended to provide a knife sharpening device which ensures that the blade of the knife to be sharpened cannot be damaged by contact with housing parts, metallic springs and other components of the knife sharpening device when inserted into the slot of the knife sharpening device.

Components of the knife sharpening device, such as sharpening inserts for sharpening and/or honing or polishing the knife, as well as the springs, shall be protected from contamination, especially from food residues adhering to knife blades. The term grinding of the knife further includes the term sharpening of the knife.

The cleaning of the knife sharpening device should also be able to be carried out by a technically unskilled user.

The knife sharpening device shall comprise a smaller number of components and parts compared to other devices for sharpening knives known from the prior art. The manufacturing costs of the knife sharpening device shall thus be significantly reduced.

The insertability of the blade of the knife to be sharpened into the V-shaped arrangement of the sharpening rods is to be improved. In addition, the knife sharpening device is to be usable for knives of all types and grades, for single-fiber blades as well as for multi-fiber knife blades.

Solution of the Objects

The objects are solved by a knife sharpening device according to the features of claim 1.

Advantageous embodiments and variants of the invention are shown in the subclaims.

Knife sharpening device in the sense of the invention is understood to mean such a device which is designed not only to sharpen knives, scissors and other tools for chipless cutting or incising of different materials, but also to grind, hone and polish them.

In the following, it is exemplarily, but not exclusively, assumed that the knife sharpening device is used for sharpening, honing, and/or polishing knife blades.

The knife sharpening device comprises sharpening rods which, in a rest position, are each arranged at a predetermined angle to each other by the force of a respective spring. The two sharpening rods are arranged adjacent to each other. The two sharpening rods may also be arranged overlapping each other.

The knife sharpening device comprises at least two sharpening rods. The two sharpening rods are pivotally mounted on a base.

The rest position is the position of the knife sharpening device in which the knife blade is not yet inserted into the V-shaped arrangement of the sharpening rods.

In contrast, the sharpening position describes the position of the knife in which the blade of the knife is inserted into the V-shaped arrangement of the sharpening rods. In the sharpening position, at least one side of the blade of the knife is in contact with the sharpening rods.

Each sharpening rod is held in place by a spring. The two sharpening rods assume a predetermined angle to each other due to the restoring force of the springs.

Base

By the term base, the invention means a component on which the at least one sharpening rod is pivotally mounted.

The base is a body having a three-dimensional figure. The three-dimensional figure is defined and/or described by its surface. The base may be cylindrical or rectangular in shape.

By way of example, and in no way exclusively, the base may be formed as a sphere, a pyramid, or a cube.

The surface of the base may be composed of flat or curved surface pieces.

The base may be annular in shape or may have the shape of a cylinder or a hollow cylinder.

In a further embodiment of the invention, the base may be in the form of a cone.

The base may further be an internally hollow body. The base may also be a solid body formed at least in certain areas.

In the following, it is assumed purely by way of example, but not exclusively, that the base is formed as a housing at least in certain areas.

The housing will be discussed in more detail below.

It will be understood that the base may also assume another geometric shape.

In one embodiment of the invention, the base serves to grip and/or hold the at least one knife sharpening device.

The base comprises at least one profile against which and/or into which the user of the knife sharpening device can place at least one finger of his hand.

The base may be made, at least in part, of at least one material that is comfortable or convenient to hold in the hand. The material may be non-slip or fluid repellent. The base may be made of any material.

Fastening Device

According to a preferred embodiment of the invention, the base comprises a fastening device on at least one side facing away from the sharpening rods.

With the aid of the fastening device, a vacuum is preferably created under the side of the base with which the base rests on a substrate for fastening.

The attachment of the knife sharpening device to or on the base can also be accomplished magnetically or in any other non-positive and/or positive manner.

Handle Element

According to a further preferred embodiment of the invention, at least one handle element is arranged on at least one side of the base.

The handle element may be an open handle or a closed handle. Furthermore, the handle element may be a rod.

It is understood that the handle element may also be formed in any other manner.

The handle element refers to a device by which the knife sharpening device can be grasped and/or held and/or moved by the user.

The handle element is formed as part of the guide element. The guide element will be discussed in detail below.

The handle element may be made of the same material(s) as the base. The handle element may be made of at least one material that differs in type and grade from the at least one material of the base.

The handle element is configured to allow the user to hold the knife sharpening device in a non-slip and/or non-losing manner.

The handle element may have at least one profiling.

The grip element may be integrally connected to the material of the base. The handle element may also be formed in a shape that is removable from the base.

Housing

The base is formed as a housing, at least in certain areas.

The housing has a circumferential wall which delimits the outside of the base from the inside of the base.

The inside of the base is designed to accommodate, preferably but not exclusively, the bearing for the at least two sharpening rods which can be pivoted relative to the base.

On its upper side facing the sharpening rods, the housing has at least one opening through which the sharpening rods project into the housing for mounting relative to the housing.

The housing can be opened. It may be formed in such a way that the housing can be completely or partially disassembled into at least two halves.

According to an additional embodiment of the invention, the housing may be formed as a protective body.

The housing formed as a protective body receives the ends of the sharpening rods extending into the housing. The ends of the sharpening rods projecting into the housing as well as the springs, preferably arranged on a sharpening rod, are protected by the housing from contact by the user.

The housing, which is designed as a protective body, serves to protect the sharpening rods and the springs from damage and/or from contamination.

The housing hides the functional parts of the knife sharpening device, such as for example the ends of the sharpening rods projecting into the housing and the springs, from the user's view.

Discharge Device

On the inner wall and/or on the outer side of the housing, the housing has at least one discharge device.

The discharge device serves to discharge solids and/or fluids which penetrate into the interior of the housing of the base during sharpening of the knife.

Preferably, with the aid of cleaning fluids, the fluids and/or solids are drained and removed from the outside and/or from the inside of the housing.

The cleaning fluid thereby flushes the contaminating solids or fluids preferably downwards out of the housing of the base.

Guide Element with Slot

The guide element is positioned on the side of the base on which the sharpening rods protrude from the housing.

The guide element preferably extends axially parallel to the sharpening rods on at least one side of the sharpening rods.

A guide element can also be arranged on each of the two sides of the sharpening rods, axilly parallel of the sharpening rods.

The guide element comprises a slot. The slot is open at the end of the guide element facing away from the base. At the end of the guide element facing the base, however, the slot is closed.

The V-shaped arrangement of the sharpening rods and V-shaped arrangement of the slot are axially aligned with each other.

By the term slot, the invention means a groove in the form of an elongated and/or a beveled and/or an angled incision in the guide element. The slot extends in the guide element transversely to a plane in which the guide element extends. The slot can be sawn into the guide element. The slot can also be milled.

The slot extends inside the guide element from its upper edge downwards in the direction of the base on which the guide element is fastened for vertical arrangement.

The width of the slot can vary along its length.

The edges of the slot within the guide element have a single or multiple curved course. Alternatively, the edges of the slot may have a straight course.

The edges of the slot are rounded. However, they may also assume another geometric shape.

One embodiment of the invention provides that the slot in the guide element has an exponentially increasing width from its closed end to its open end.

At its upper edge, the guide element has an insertion area which serves to facilitate the insertion of the blade into the slot of the guide element and between the two sharpening rods.

This can facilitate the insertion of wider blades in particular. In addition, the material of the guide element is prevented from being damaged when the blade is inserted into the slot.

It is prevented that the material of the guide element and/or the material of the sharpening rods is scraped off and/or cut into and/or damaged in another technical manner when the knife is inserted between the preferably V-shaped sharpening inserts of the sharpening rods.

The guide element is constructed of a cut-resistant material.

In the insertion area of the slot, the edges of the slot can exemplarily and in no way exclusively comprise an angle of 80°-120°.

Sharpening Rod

According to the invention, the knife sharpening device comprises at least two sharpening rods.

The sharpening rods are each arranged on the base. In their arrangement on the base, the sharpening rods are positioned in a V-shape.

The V-shaped arrangement of the sharpening rods relative to one another serves to insert a knife between the sharpening rods.

In a rest position, the sharpening rods are each held at a predetermined distance in their V-shaped arrangement by the force of a spring.

In a sharpening position, the sharpening rods are spreadable apart against the force of the spring upon insertion of the knife and upon contact of the knife with the sharpening inserts.

According to the invention, a single holding point is provided by means of which the sharpening rods are held to the base.

For pivoting the sharpening rods relative to the base, a pivot axis is arranged at an angle to the base.

The pivot axis extends at an angle to the base. Preferably, the angle is a right angle. However, another angle may also be assumed.

The pivot axis extends along and/or parallel to the axis of the longitudinal axis of the trunnion and/or the partial trunnion.

According to the invention, the single holding point over which at least one sharpening rod is movable relative to the base is formed by the trunnion and/or the two partial trunnions.

The pivot axis running along the longitudinal axis of the trunnion and/or the partial trunnions runs through the single holding point of the at least one sharpening rod relative to the base.

The material of the sharpening rod is preferably a material that does not additionally blunt or otherwise damage the knife when the knife contacts the sharpening rod upon insertion of the knife into the slot.

Each of the two sharpening rods is provided as a support for at least one sharpening insert.

The sharpening rod is an elongated and/or rod-shaped object. The sharpening rod has a solid shape. Preferably, the sharpening rod has a round cross-section. The cross-section of the sharpening rod may also be square. It goes without saying that the sharpening rod can also have any other cross-section.

A spring is arranged on each sharpening rod. The respective spring is fastened to the associated sharpening rod in such a way that it cannot be lost.

If insertion element is provided, at the end of the spring facing the closed end of the slot of the guide element, the spring is fastened to the sharpening rod via a retaining device. At the end of the spring facing the open end of the slot of the guide element, the spring is attached to the sharpening rod via a trunnion of the sharpening rod.

The sharpening rods each have at least one sharpening insert. The two sharpening rods are arranged at an angle, preferably in a V-shape, to each other. When the knife is inserted between the sharpening rods arranged in a V-shape relative to one another, the blade of the knife comes into contact with at least two sharpening inserts. One sharpening insert is assigned to each of the two sharpening rods. Against the restoring force of the springs, the sharpening rods are thus transferred from the rest position to the sharpening position.

The sharpening rods run in a V-shape without crossing each other. The V-shape in the sense of the invention can also include an arc shape.

The V-shaped arrangement of the sharpening rods can comprise an angle of exemplarily and not exclusively 11° to 21° between the sharpening rods in the area of the holding device.

The V-shaped arrangement of the sharpening rods and the slot of the preferably arranged guide element are arranged axially aligned with one another on a common axis.

In the sharpening position, the blade of the knife is in contact on both sides with one sharpening insert of each sharpening rod.

In the sharpening position, the sharpening rods with the sharpening inserts arranged in and/or on the sharpening rods are subjected to the restoring force of the springs.

The force exerted by the user via the knife on the sharpening inserts and indirectly via the sharpening inserts on the sharpening rods causes the sharpening rods to spread apart against the restoring force of the springs.

If a guide element is arranged, then in the region of the closed end of the slot of the guide element the two sharpening rods are hinged to the base via a common pivot axis.

In the region of the closed end of the slot of the guide element, which is preferably arranged in the base, the two sharpening rods are hinged to the base via a common pivot axis.

A holding device is provided in which the springs are held with their lower ends. The holding device is pivotably hinged to the guide element via the pivot axis.

It is provided that the sharpening rod is designed as a protective body. The protective body is intended to prevent the user from coming into contact with the sharpening inserts with his fingers and injuring himself on them during sharpening, honing and/or polishing of the blade of the knife with the aid of the knife sharpening device and/or during assembly of the knife sharpening device and/or during maintenance of the knife sharpening device.

The two sharpening rods are pivotally supported relative to the base at a distance from the preferably arranged guide element.

The movement of the sharpening rods relative to each other takes place in a plane parallel to the plane in which the guide element extends.

In the area of the closed end of the slot of the guide element, the two springs engage in the holding device and are fixed therein.

In the area of the open end of the slot of the guide element, the springs are free to pivot. In the region of the open end of the slot of the preferably arranged guide element, the respective spring is connected to the associated sharpening rod.

In the region of the open end of the slot, the springs can be pivoted against each other.

The springs are fixed in the holding device and in this fixation can be transferred from a rest position to a sharpening position.

In the region of the closed end of the slot of the preferably arranged guide element, the sharpening rods are mounted on the base via a common pivot axis.

According to the invention, a single holding point is arranged. The sharpening rods are held on the base via the single holding point.

The holding point is described in detail below.

Holding Point of the Sharpening Rod

A single holding point is provided for supporting the sharpening rods relative to the housing of the knife sharpening device.

The sharpening rods are held to the base via the single holding point.

The single holding point is located in the housing. At the single holding point, the sharpening rods are held against each other and/or against the base.

Preferably, but in no way exclusively, the single holding point is arranged inside the housing on a wall of the housing.

The holding point for the sharpening rods may be formed as a trunnion inside the housing.

The trunnion may be rotatably hinged to the wall of the housing on the interior wall of the housing.

The trunnion may be connected to at least one sharpening rod of the knife sharpening device.

At least one sharpening rod is rotatably mounted on the trunnion for moving the at least one sharpening rod from a rest position to a sharpening position.

At least one further sharpening rod is fixedly connected to the trunnion.

In an additional embodiment of the invention, both sharpening rods are rotatably mounted on the trunnion.

In another embodiment of the invention, both sharpening rods comprise at least one partial trunnion at each of the ends of the sharpening rods that extend into the interior of the housing of the knife sharpening device.

Preferably, but not exclusively, the partial trunnion has a short end. It is understood that the partial trunnion may also comprise a long end.

The partial trunnion of a sharpening rod is respectively rotatably mounted at its short end on the inner wall of the housing.

The long ends of the partial trunnions of the sharpening rods are each arranged in alignment with one another and opposite one another. The long ends of the two partial trunnions of the sharpening rods engage with each other to form a common trunnion.

The long ends of the partial trunnions can engage with each other as a positive connection. The long partial trunnions can also form a friction-locked connection.

Sharpening Insert

At least one sharpening insert is arranged on each sharpening rod.

This means that sharpening inserts of different types and qualities can be arranged on the sharpening rod, e.g. for grinding and/or honing and/or polishing.

The sharpening inserts are arranged on the upper side of the sharpening rod. Alternatively, the sharpening insert may be embedded in the sharpening rod. The surface of the sharpening insert is flush with the surface of the sharpening rod.

Alternatively, the sharpening insert may be glued or clamped into the sharpening rod. The sharpening insert can be inserted into the sharpening rod. The sharpening insert can be soldered or welded to the sharpening rod. It goes without saying that the sharpening insert can also be attached to the sharpening rod in a different technical manner.

The sharpening rods are arranged in a V-shape to each other. The sharpening inserts are arranged on the sharpening rods in such a way that the at least one sharpening insert of one sharpening rod is opposite the at least one sharpening insert of the other sharpening rod at the same height.

The sharpening inserts are arranged on the sharpening rods in such a way that the blade of the knife inserted between the sharpening rods comes into contact with the opposing sharpening inserts on both sides.

The knife sharpening device has sharpening inserts that are available in their entire length for processing the blade of the knife.

By means of the sharpening insert a dull knife is sharpened and/or grinded and/or honed and/or polished.

The sharpening insert comprises a material that is stronger and/or more resistant than the material of the knife.

Preferably, but in no way exclusively, the sharpening insert is made of ceramic and/or stone and/or diamond. It goes without saying that any other material may be used.

Sharpening inserts may be made of a metal. The metal may be a hard metal or a metal alloy or a bimetal.

In another embodiment, the sharpening insert is made of borozone or at least one polymer.

It is understood that the sharpening insert may also be made of a composite material.

Sharpening inserts may further be synthetic grinding stones. Exemplarily and in no way exclusively abrasive materials, such as corundum, oxide ceramics, non-oxide ceramics and silicon carbide, may be used.

Similarly, the sharpening insert may be a natural water stone. By way of example and in no way exclusively, the sharpening insert may be a mica stone or a phyllite.

In further embodiments, the sharpening insert may be an oilstone and/or a diamond stone.

By means of the different materials used to make the sharpening inserts, sharpening inserts can be made that can be applied for grinding and/or honing and/or polishing and/or for knives for serrations.

Another embodiment of the invention provides that the sharpening inserts have at least two areas for bringing about different sharpening effects and/or sharpening intensity.

When the blade of the knife is inserted between the sharpening rods, which are preferably arranged in a V-shape, and when the blade is placed against the sharpening inserts, different sharpening inserts and/or different areas of a sharpening insert can be used, depending on the type and intended use of the knife.

It is further provided that in the sharpening position, one sharpening rod with its sharpening insert contacts each side of the blade of the knife.

In addition, it is achieved that, preferably in the case of knives with serrations, the blade can be inserted at an angle relative to the longitudinal axis of the base between the sharpening rods, which are preferably arranged in a V-shape. In this way, the individual waves of the serrated cut are sharpened and/or honed and/or polished.

An advantage is that all sharpening inserts arranged on the sharpening rod and/or all areas of the respective sharpening inserts can be used for sharpening and/or honing and/or polishing the knife.

By applying greater pressure to the blade against the restoring force of the spring, the blade of the knife reaches the lower area of the springs and/or the sharpening inserts in the lower area of the sharpening rod. In particular, blunt bevels of a blade can be precisely ground and/or honed and/or polished in this way.

By applying less pressure to the blade, the blade of the knife only reaches an area of the sharpening inserts and/or the sharpening inserts in the area of the open end of the sharpening rod due to the restoring force of the springs. The lower pressure effect on the blade of the knife causes the blade to be ground and/or honed and/or polished in a gentler manner.

The sharpening rods and/or the sharpening inserts and/or the holding device and/or the springs and/or the pivot serving as a pivot axis can be combined to form an exchange module.

This ensures easy assembly of the knife sharpening device by the user. The user can remove the exchange module from the knife sharpening device in one piece and replace it with a new exchange module when the sharpening inserts have become blunt after long use.

The exchange module can be inserted into the knife sharpening device when the sharpening rods and/or the sharpening inserts and/or the holding device and/or the springs and/or the trunnion forming the pivot axis are damaged.

The exchange module can be easily replaced by the user without risk of injury to the user's hands.

Grinding Insert

At an angle to a longitudinal axis of the sharpening insert, at least one grinding insert is arranged next to the sharpening insert on the sharpening rod.

Relative to the slot between the sharpening rods, the sharpening insert is arranged in the region of the upper end of the slot.

In contrast, relative to the slot between the sharpening rods, the grinding insert is arranged in the region of the lower end of the slot.

The invention provides that the grinding insert is made of hard metal and/or of a hardened metal and/or of sintered metal and/or of ceramic and/or of stone.

The grinding insert may be formed as at least one hard metal plate.

It is understood that the grinding insert may also be made of other materials.

Working Areas of the Sharpening Insert

The sharpening insert comprises as working areas a sharpening edge and/or a honing edge and/or a polishing surface.

The sharpening insert is elongated and/or rod-shaped. The sharpening insert is arranged on the surface of the sharpening rod.

The sharpening insert extends along the longitudinal axis of the sharpening rod.

The sharpening rods carrying the sharpening inserts are arranged in a V-shape to each other. The sharpening rods can be pivoted in opposite directions about the pivot axis.

When the sharpening rods are pivoted about the pivot axis, the two sharpening rods with the sharpening inserts arranged on them move radially in opposite directions.

Polishing Surface

The sharpening insert comprises at least one surface which is designed as a polishing surface. The polishing surface of the sharpening insert is flush with the surface of the sharpening rod.

The polishing surface is a plane and flat surface.

The polishing surfaces are arranged on the sharpening inserts in such a way that they move radially in opposite directions when the sharpening rods are pivoted about the pivot axis.

To polish the knife, the blade is pulled horizontally through the sharpening rods. The bevel of the blade slides along the polishing surfaces of the V-shaped sharpening rods on both sides.

When the knife is polished, the previously ground and/or honed bevel of the blade is polished. The blade is additionally compacted and further sharpened by the polishing process.

Transverse to the longitudinal axis of the sharpening insert, the surface of the sharpening insert has one end face on each side.

One end face is designed as a sharpening edge. The opposite end face forms a honing edge.

Sharpening Edge

The sharpening edges are arranged approximately at right angles to the pivot direction of the sharpening rods about the pivot axis. The sharpening edges of the sharpening inserts are arranged relative to the V-shaped arrangement of the sharpening rods in such a way that the sharpening edges of the sharpening inserts of both sharpening rods face the blade of the knife.

The end face of the sharpening insert, which is designed as a sharpening edge, has an angle of between 45° and 89° relative to the surface of the sharpening insert. It goes without saying that the end face formed as a sharpening edge can also have a different angle relative to the surface of the sharpening insert.

To sharpen the knife, the blade is pulled through the sharpening rods with the tip of the blade pointing downwards. Here, the bevel of the blade slides along the sharpening edges of the V-shaped sharpening rods on both sides.

As the knife is sharpened, material is removed from the bevel of the blade as it is pulled through.

Honing Edge

The honing edges are arranged approximately perpendicular to the pivoting direction of the sharpening rods about the pivot axis. The honing edges of the sharpening inserts are arranged relative to the base in such a way that the honing edges of the sharpening inserts of both sharpening rods face away from the base.

The honing edge is designed as a curved edge. The honing edge may have a round or oval or arcuate profile. The honing edge can also have a different geometric shape.

The honing edge is embedded in the sharpening insert. For fixing the sharpening insert to the sharpening rod, the sharpening insert has a support.

The honing edge has a profiling at least in some areas. The profiling has a roughened surface similar to sandpaper. The profiling comprises irregularities, preferably knobs and/or grooves running longitudinally or transversely. It may also have any other geometric shape.

The honing edge is made of a material that is harder than the material from which the blade of the knife is made.

To hone the knife, the blade is pulled through the sharpening rods with the tip of the knife facing upwards. During this process, the bevel of the blade slides on both sides along the honing edges of the V-shaped sharpening rods.

When the knife is honed, the steel chips or material threads remaining on the blade from the grinding process are removed from the blade of the knife.

Any unevenness on the blade remaining after the sharpening process is leveled when the blade is honed.

Knife

The knife sharpening device is designed not only to sharpen, but also to hone and polish preferably knives, but also scissors and other tools for chipless cutting or incising of different materials.

The term knife refers to a tool used for cutting. The knife includes a blade, as well as a handle. The blade is used for cutting a material and/or an object that has a lower material hardness than the material of the blade on the handle.

For purposes of the invention, knives are configured as work knives, professional knives, and recreational knives. Knives can be part of a cutlery set or be household and kitchen knives. In addition, knives exist as industrial knives, combat knives, shaving knives and/or ritual knives.

The listing of knives is in no way intended to be exclusive, but only exemplary in nature. Knives may also have other forms and/or functions.

In particular, kitchen knives exist as all-purpose or larding knives. In addition, boning knives, bread knives, fret knives, fillet knives, fruit or fruit knives, vegetable knives, cheese knives, chef's knives, parmesan knives, paring or touring knives, ham or salmon knives, tomato knives, carving or meat knives, and cradle knives are known. This listing is also in no way meant to be exclusive, but only exemplary in nature.

In construction, the knife includes the blade for cutting. The blade has a so-called bevel as a cutting edge.

The bevel is the thinnest area of the blade in terms of material thickness. The bevel forms the area of the blade with which a material is cut.

Spring

The spring is a metallic, technical component that is elastically deformable. The spring produces a restoring force that returns the spring from a sharpening position to a rest position after a force acting on the spring is removed.

The spring of the knife sharpening device has a spring pressure that can be varied depending on the type and quality of the knife to be sharpened. In this way, an optimum grinding result can be achieved.

The spring is made of at least one metallic material.

The spring may be designed as a torsion spring. By way of example and in no way exclusively, the torsion spring may be a rod spring or a helical spring.

The spring may also be designed as a bending spring. The bending spring may be in the form of a leaf spring or may be formed as a wire spring. The spring may additionally be a rod spring.

It goes without saying that other cross sections, such as a square or rectangular cross section, can also be used.

One spring respectively is associated with each sharpening rod. The spring is held at its lower end in the holding device. In the area of the open end of the slot, the respective spring is attached to the associated sharpening rod.

The pivotable mounting of the two sharpening rods and the holding device for receiving the two springs about the common pivot axis in the region of the closed end of the slot ensures that the sharpening rods and the respective associated spring can be pivoted at the same angle and over the same distance when a force is applied against the restoring force of the springs.

The arrangement of the spring on the side of the sharpening rod facing the base allows the springs to be arranged without injury.

The arrangement of the springs respectively on the holding device and on the sharpening rod results in a more direct influence of the restoring force transferred from the sharpening rod to the sharpening insert.

The two sharpening rods and the spring arranged on the sharpening rod in each case make it possible to vary the restoring force that the user can apply to the blade in the upper area and/or in the middle area and/or in the lower area of the sharpening inserts.

The blade of the knife does not run the risk of unintentionally coming into contact with the springs when inserted into the slot of a preferably arranged guide element, which can lead to additional blunting of the spring.

Since the sharpening rod is designed as a protective body, there is no risk of the user's fingers coming into contact with the sharpening inserts and/or the spring of the sharpening rods and injuring himself.

The respective springs are not attached to the base, but to the sharpening rods and to the holding device.

The restoring force of the spring can be varied. In this way, the pressure acting on the blade of the knife via the sharpening inserts can be adapted to the type and quality and/or to the respective function of the knife.

Grinding the Knife

When grinding, material is removed from the blade in the area of the bevel.

To grind the blade of the knife, the blade is inserted between the sharpening rods with its tip down. The sharpening rods are arranged in a V-shape.

When the blade of the knife is inserted between the sharpening rods, the bevel of the blade comes into contact with both sides with the sharpening inserts of the sharpening rods arranged opposite each other.

With the pressure exerted by the user when inserting the blade between the sharpening rods with the blade on the sharpening inserts, the two springs and the sharpening rods connected to the springs and the sharpening inserts arranged on the sharpening rods are transferred from the rest position to the sharpening position against the restoring force of the springs.

With the reduction of pressure on the springs when the blade of the knife is released from the sharpening inserts of the sharpening rods, when the knife is brought out of the V-shaped arrangement of the sharpening rods, the two springs and the sharpening rods connected to the springs and the sharpening inserts arranged on the sharpening rods are transferred from the sharpening position to the rest position by the restoring force of the springs.

The user pulls the blade of the knife from the handle to the tip of the blade along the sharpening inserts arranged opposite each other.

Through sharpening, even very dull knives can be used again in a functionally appropriate manner.

It goes without saying that the knife can be sharpened in the same way but from the tip of the knife to the handle of the knife.

To achieve the sharpening insert, the user inserts the blade of the knife into the slot in the V-shaped arrangement of the sharpening rods.

The user guides the blade of the knife towards the lower end of the slot, beyond the area of the sharpening insert of the sharpening rods.

In the longitudinal axis behind the sharpening insert, in the area of the lower end of the slot, the blade of the knife comes into contact with the sharpening inserts of the respective opposite sharpening rods.

By way of example, it is assumed that the grinding insert is in the form of a hard metal platelet In other words, the user inserts in particular very blunt and worn blade of the knife in the direction of the lower end of the slot into the V-shaped arrangement of the sharpening rods.

In the longitudinal axis of the sharpening insert, but axially behind the sharpening inserts, the user brings the blade into contact with the carbide tips of the opposing sharpening rods.

By moving the blade along both sides of the sharpening inserts, especially from the hilt of the knife to the tip of the blade, the blade is sharpened.

Particularly worn and dull blades are resharpened with the grinding inserts. Scraped metal particles are removed from the blade. The blade of the knife is reconstructed.

After the sharpening process on the grinding inserts of the sharpening rods has been completed, the blade is fed to the sharpening inserts of the sharpening rods for honing and/or polishing and/or smoothing.

Honing

During honing, a fine grinding of the blade is achieved. Honing removes the burrs that form during sharpening.

By honing the bevel of the blade, the blade is smoothed after the sharpening process.

To hone a blade with the knife sharpener, the blade of the knife is inserted through the V-shaped arrangement of the sharpening rods with the point facing upwards.

When the blade of the knife is inserted between the sharpening rods, the bevel of the blade comes into contact on both sides with the sharpening inserts of the sharpening rods arranged opposite each other.

After the blade is placed against the opposing sharpening inserts of the sharpening rods, the blade is pulled along the edges of the sharpening inserts with its bevel from the handle to the tip of the blade against the restoring force of the spring.

Pulling the blade of the knife with the knife sharpening device keeps the bevel of the blade of the knife permanently sharp.

Polishing

By polishing, the invention means a smoothing finishing of the bevel of the blade of the knife.

The roughness peaks of the surface structure of the bevel of the blade remaining from grinding and/or honing are plastically and/or partially plastically deformed and leveled.

In addition, a minimal material removal of the bevel of the blade of the knife takes place during polishing. Likewise, the polishing process can be used to fill depressions in the area of the bevel of the blade of the knife.

When polishing the bevel of the blade, the user presses the sharpening rods with the sharpening inserts arranged thereon outward against the restoring force of the associated springs relative to the center line of the V-shaped arrangement of the sharpening rods.

The blade of the knife is inserted into the slot approximately parallel to the base of the knife sharpening device.

The bevel of the blade of the knife comes into contact with the sharpening inserts of the two sharpening rods arranged at an angle to each other. For polishing, the blade of the knife is moved with its bevel approximately parallel to the top of the base and along the sharpening inserts.

During polishing, the movement of the bevel of the blade of the knife along the sharpening inserts is performed without any additional restoring force by the user.

Grinding a Serrated Knife

The invention understands by the term serrated grinding a bevel of the blade of the knife with so-called saw teeth.

For sharpening the serrated blade of the knife, the blade is inserted horizontally between the sharpening rods. The sharpening rods of the knife sharpening device are arranged in a V-shape.

When the serrated knife blade is inserted between the sharpening rods, the bevel of the blade comes into contact on both sides with the sharpening inserts of the sharpening rods arranged opposite each other.

With the pressure exerted by the user when inserting the blade between the sharpening rods with the blade on the sharpening inserts, the two springs and the sharpening rods connected to the springs are transferred from the rest position to the sharpening position against the restoring force of the springs.

The tip of the knife is pivoted relative to a pivot axis toward the side facing away from the serrated edge of the knife blade. The pivot axis extends from top to bottom through the base of the knife sharpening device.

When sharpening a serrated knife, the pull-through of the knife's blade occurs horizontally along the sharpening inserts of the sharpening rods with moderate restoring force by the user.

With the reduction of pressure on the springs when the blade of the knife is released from the sharpening inserts of the sharpening rods when the knife is brought out of the V-shaped arrangement of the sharpening rods, the two springs and the sharpening rods connected to the springs are transferred from the sharpening position to the rest position by the restoring force of the springs.

The advantage is that the waves of the serrated section can be sharpened on one side, on one side of the blade.

The individual waves in the serration are retained by the sharpening with the aid of the knife sharpening device.

Advantages of the Invention

With the sharpening rods pivoting in opposite directions, the associated sharpening inserts can also be pivoted against each other at the same angle and over the same distance.

Due to the design, the restoring force acts more directly on the respective sharpening rod.

The knife sharpening device also proves to be advantageous because both the areas of the base and the areas of the handle element can be used as advertising space visually separated from each other.

Contamination by abrasion and/or by sharpening plates of the knife sharpening device, preferably made of a ceramic hard metal, can be effectively avoided with the aid of the discharge device.

Another advantage of the knife sharpening device is that the sharpening performance of the sharpening inserts can be maintained over a longer period of time.

The knife sharpening device can also be used for larger knives, since an enlarged base can be used to prevent the knife sharpening device from tipping over.

The mounting of the two sharpening rods and the holding device by the pivot axis on the base has the advantage that the sharpening inserts of the sharpening rods can be used over their entire length for sharpening, honing and/or polishing the knife.

The approximately V-shaped arrangement of the two sharpening rods relative to each other means that the blade of the knife can be ground and/or honed and/or polished over the entire length of the two sharpening inserts.

Another advantage of the invention is that the knife sharpening device makes do with a reduced number of individual parts and components. This can additionally reduce the manufacturing costs.

The design of the knife sharpening device allows for easier assembly by the user and/or by the manufacturer. In addition, a more robust design can be achieved.

Widening of the sharpening rods transverse to the longitudinal axis of the base results in a greater distance from the knife blade and/or from the sharpening inserts to the user's hand.

Varying the restoring force with which the user can bring the knife into contact with the sharpening inserts allows for improved sharpening and/or honing and/or polishing of the knife, depending on the type and/or nature of the knife.

Further examples and embodiments of the invention are described in more detail with reference to the drawing.

Figure 2:
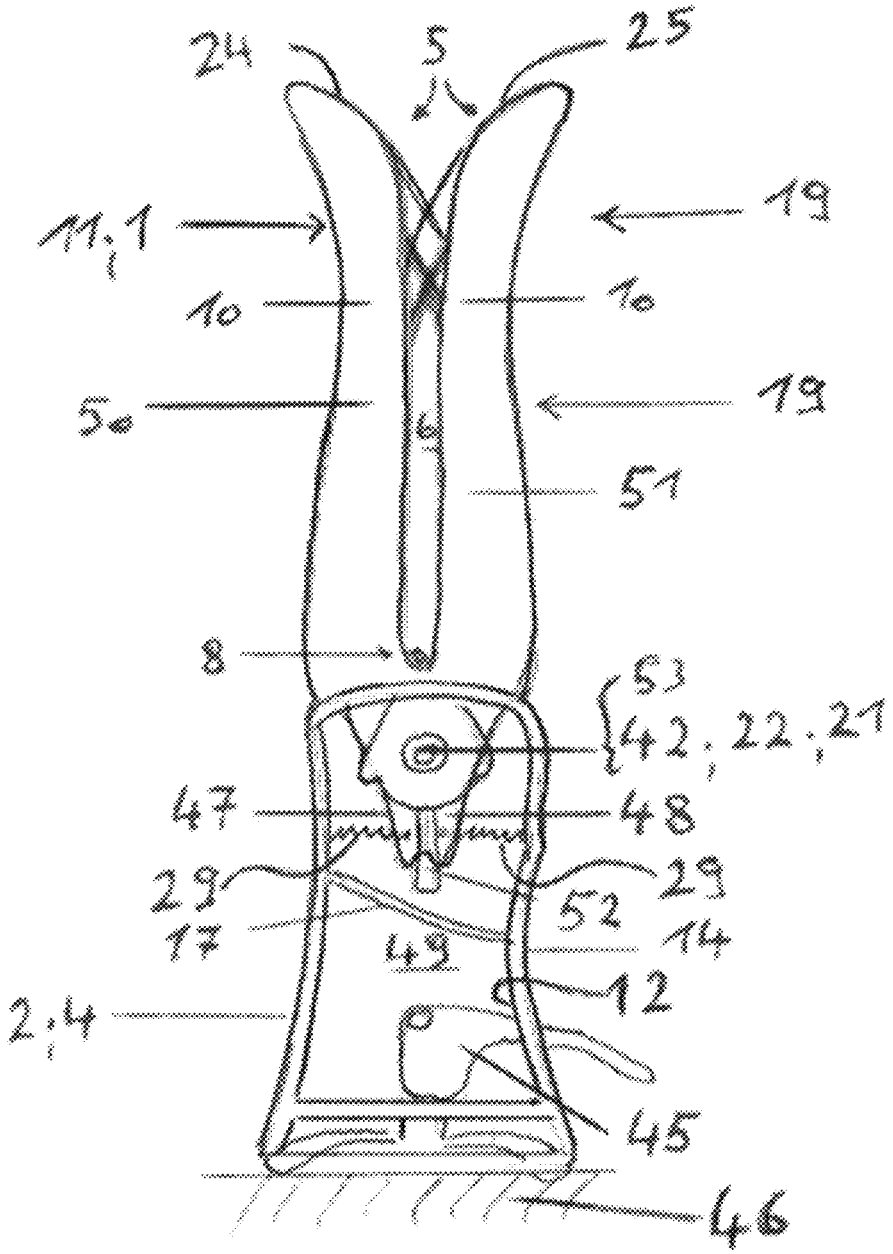
Figure 3:
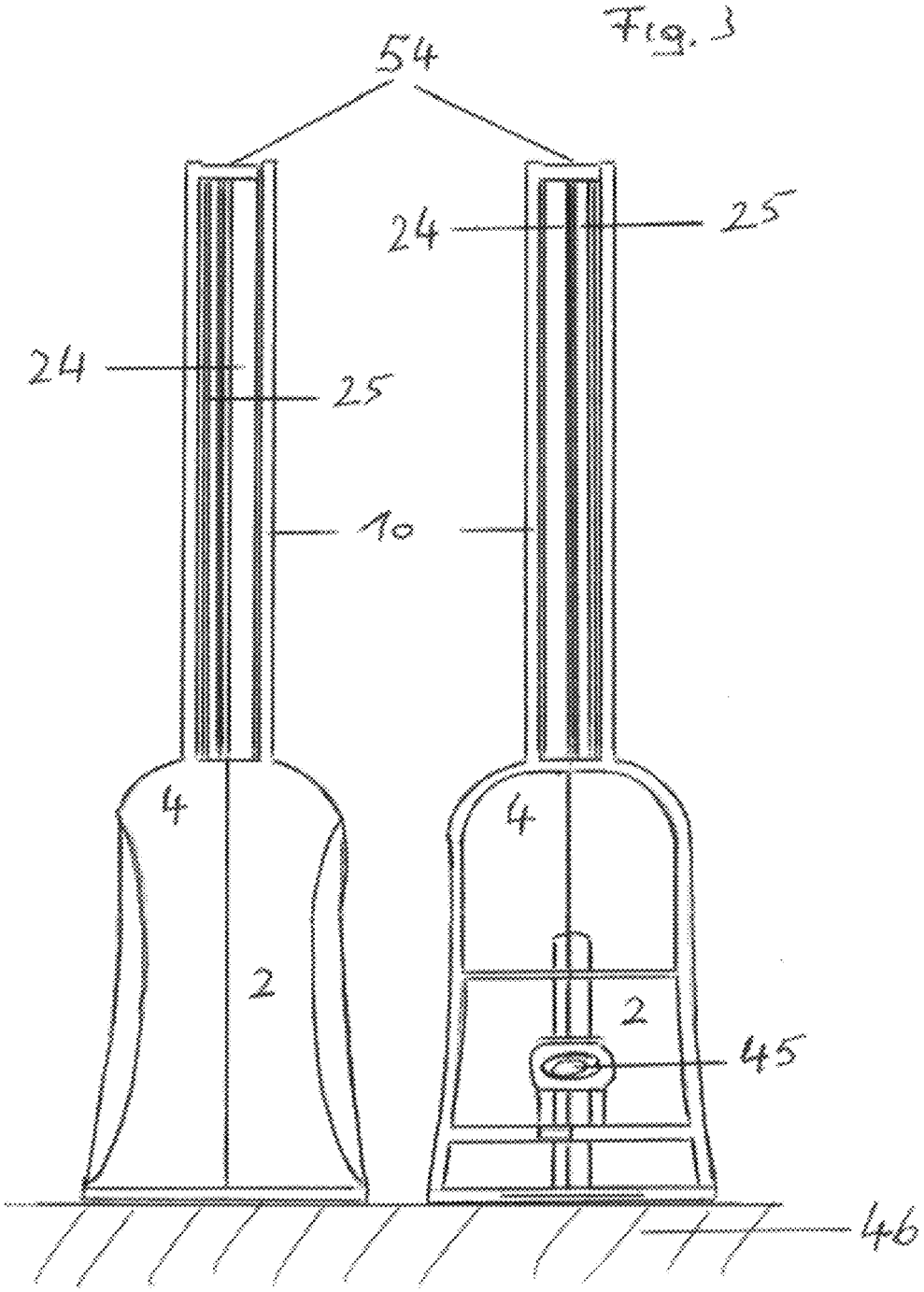
Figure 4:
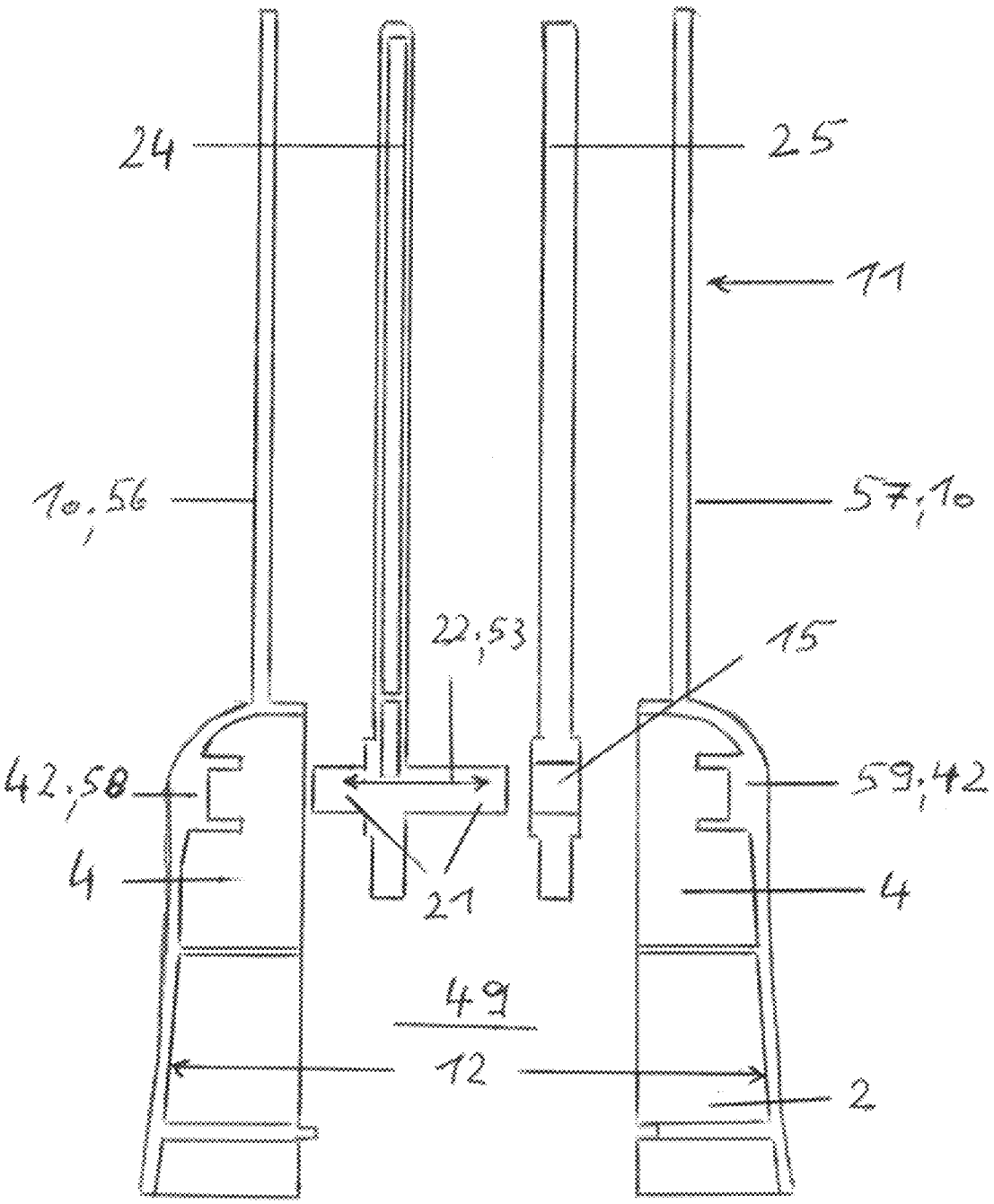
Figure 5:
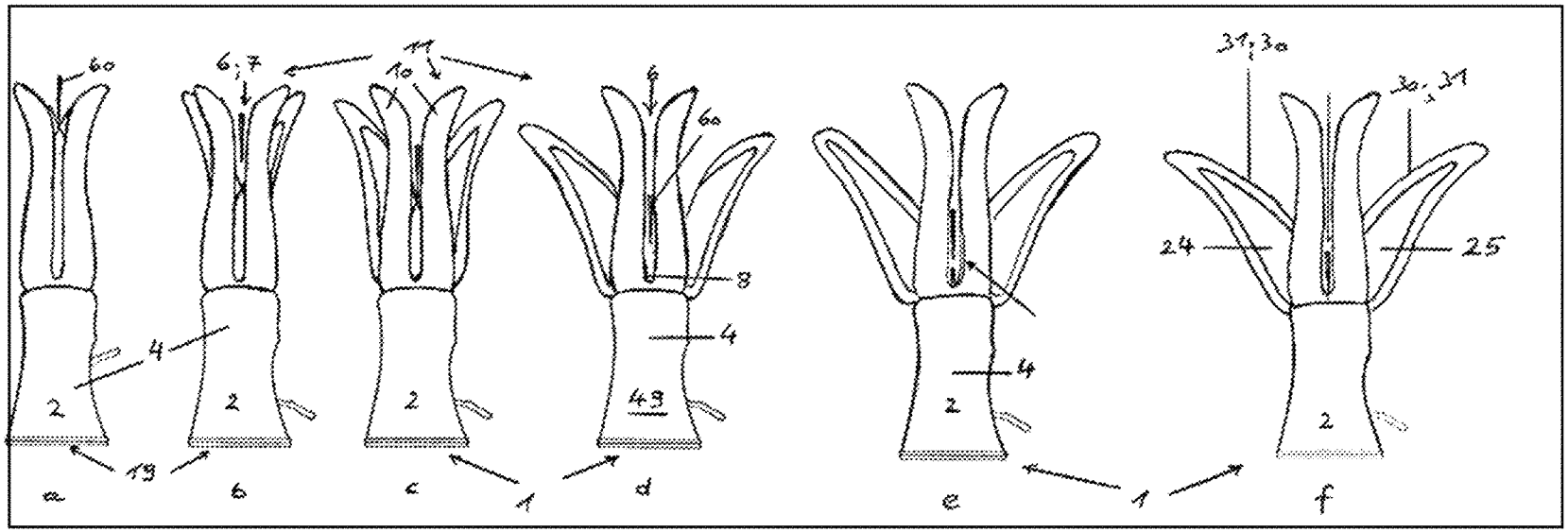
Figure 6:
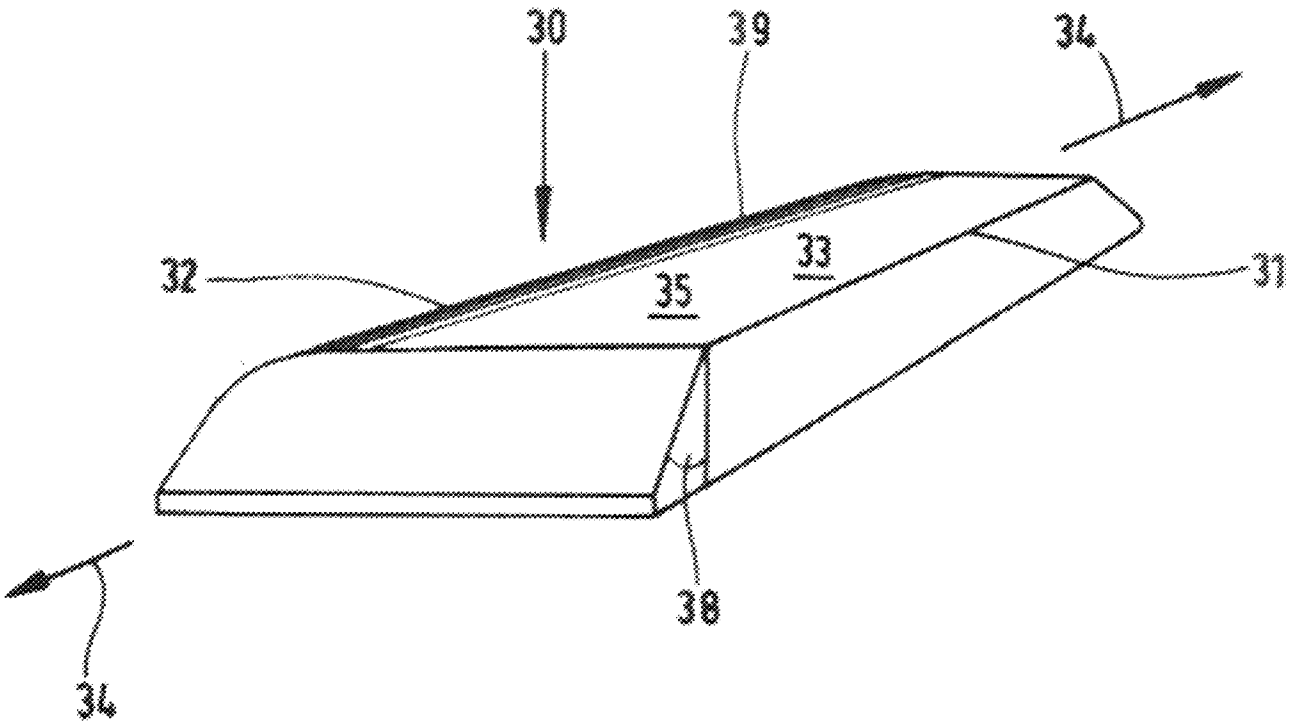
Figure 7:
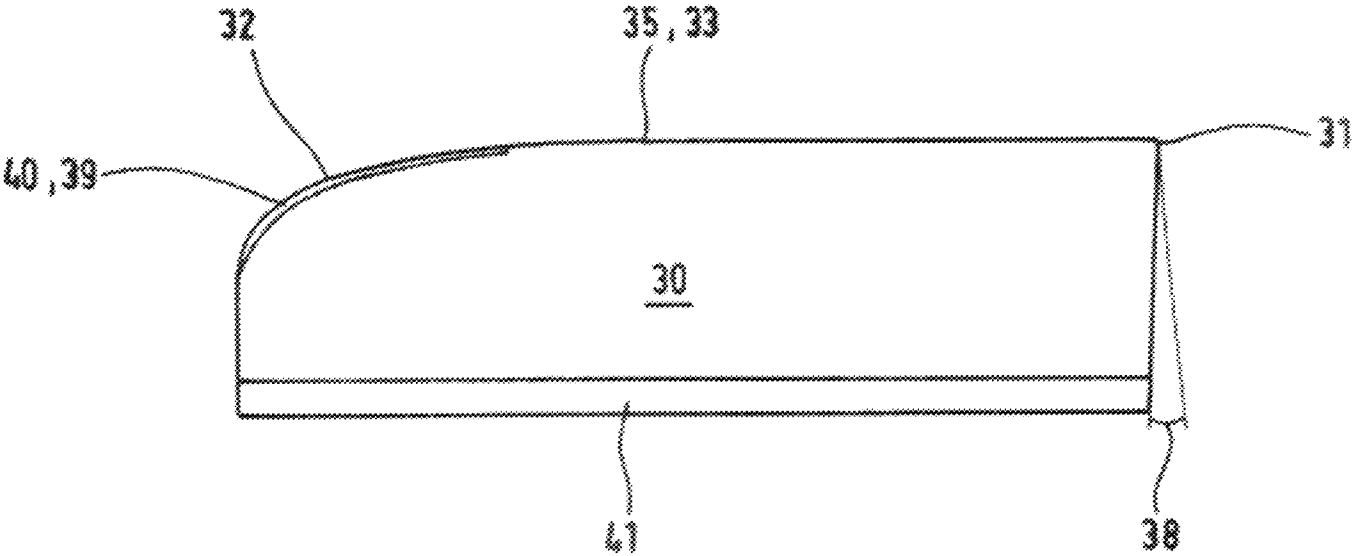

Hereby show:

FIG. 1 shows a front view of the knife sharpening device looking into the housing, FIG. 2 shows the knife sharpening device in front view, with sharpening rods in rest position, FIG. 3 shows the knife sharpening device in side view with guide elements, FIG. 4 shows the knife sharpening device in side view in an exploded view, FIG. 5 shows in a sequence of images the honing process of a knife with the knife sharpening device, FIG. 6 shows the sharpening insert with its working areas, and FIG. 7 shows a lateral section of the sharpening insert.

FIG. 1 shows a knife sharpening device with a base 2 and a guide element 10 arranged on the upper side of the base 2.

The knife sharpening device is shown in front view in FIG. 1.

In the direction of view behind the guide element 10, two sharpening rods 24; 25 are arranged in FIG. 1.

A housing 4 of the base 2 is shown in FIG. 1.

The housing 4 comprises in each case a circumferential outer wall 14 and a circumferential inner wall 12. (See also FIG. 2)

A fastening device is arranged on the underside of the housing 4 of the base 2.

The fastening device shown in FIG. 1 is designed as a so-called vacuum plate.

A vacuum is generated between the vacuum plate of the fastening device and a substrate 46 by means of a lever 45 between the fastening device and the substrate 46, by means of which the knife sharpening device 11 can be fastened to the substrate 46 in a loss-proof manner. (See also FIG. 2)

A discharge device 17 extends along an inner wall 12 of the housing 4. The discharge device 17 is also shown in FIG. 2.

The discharge device 17 is used to discharge dirt particles and fluids that have entered an interior space 49 of the housing 4.

FIG. 1 shows that the ends 47 and 48 of the sharpening rods 24 and 25, respectively, project into the interior 49 of the housing 4.

The ends 47 and 48 of the sharpening rods 24 and 25 are each connected to the inner wall 12 of the housing 4 via springs 29.

In the example of FIG. 1, the springs 29 are each designed as compression springs.

The sharpening rods 24 and 25 are shown in FIG. 1 in a V-shaped arrangement 5 in a sharpening position 1.

In the sharpening position 1, the ends 47 and 48 of the sharpening rods 24 and 25 are pushed against the inner wall 12 of the housing 4. At the same time, the respective associated springs 29 of the circumferential inner wall 12 of the housing 4 are pushed together in the direction of the inner wall 12 of the housing 4, against the spring action.

Both sharpening rods 24 and 25 are held in the interior 49 of the housing 4 via the one single holding point 42 on the inner wall 12 of the housing 4 of the base 2.

A pivot axis 22, about which the sharpening rods 24 and 25 are pivotable relative to the housing 4 of the base 2, extends through a trunnion 21.

In the sharpening position 1 of the sharpening rods 24 and 25, the sharpening rods 24, 25 are shown in a V-shape 5.

The sharpening rods 24 and 25 are transferred from the rest position 19 (see FIG. 2) to the sharpening position 1 of FIG. 1 by a knife (not shown).

Each sharpening rod 24; 25 has at least one sharpening insert 30.

The knife blade 60 (not shown) is inserted at an open upper end 7, into the V-shaped arrangement 5 of the sharpening rods 24,25. Within the slot 6, the knife 60 is moved toward an opposite closed end 8.

By inserting the knife 60 toward the closed end 8 of the slot 6 of the guide element 10, the two sharpening rods 24 and 25 are spread apart against the force of the respective springs 29.

In FIG. 1, the V-shaped arrangement 5 of the sharpening rods 24 and 25 is approximately aligned with the slot 6 of the guide element 10 (see also FIG. 2).

In the longitudinal axis 34 behind the sharpening insert 30 (see FIG. 6), in the region of the lower end 8 of the slot 6, the blade 60 of the knife comes into contact with the sharpening inserts 26; 27 of the respective, opposing sharpening rods 24; 25.

In other words, the user introduces in particular a very blunt and worn blade of the knife 60, towards the lower end 8 of the slot 6 into the V-shaped arrangement 5 of the sharpening rods 24; 25.

Along the longitudinal axis 34 of the sharpening insert 30, but axially behind the sharpening inserts 30, the user brings the blade 60 (not shown) into contact with the carbide tips (grinding inserts 26; 27) of the, opposing sharpening rods 24; 25.

FIG. 2 corresponds essentially to FIG. 1, with the difference that the two sharpening rods 24 and 25 have been transferred to a rest position 19 with respect to the sharpening position 1 from FIG. 1.

In FIG. 2, the two sharpening rods 24 and 25 are aligned with two arms 50; 51 of the guide element 10 in the rest position 19.

In the interior 49 of the housing 4, the two ends 47 and 48 of the sharpening rods 24 and 25 rest against a movement limiter 52.

The movement limiter 52 fixes the two sharpening rods 24 and 25 in their rest position 19.

The springs 29 are designed as compression springs which, in the rest position of the sharpening rods 24 and 25, push off from the inner wall 12 of the housing 4 and press the sharpening rods 24 and 25 into the interior 49 of the housing 4.

The holding point 42 of the two sharpening rods 24 and 25 is arranged on the inner wall 12 of the housing 4.

The pivot axis 22 of the trunnion 21 extends along the longitudinal axis 53 of the trunnion 21.

FIG. 3 shows side views of the housing 4 of the base 2 with the sharpening rods 24 and 25 projecting from the housing 4.

In the illustrations of FIG. 3, guide elements 10 are arranged in side view.

The guide elements 10 each extend axially parallel to the sharpening rods 24 and 25.

At the ends of the sharpening rods 24 and 25, which are opposite the housing 4, the guide elements 10 are connected to each other by a bar 54 (cf. FIG. 3).

In the right-hand side views of FIG. 3, lever 45 is shown, which is associated with the fastening device.

The fastening device is used to fasten the housing 4 of the base 2 to the substrate 46.

FIG. 4 shows an exploded view of the knife sharpening device 11 with halves 56 and 57 of the housing 4.

The two halves 56 and 57 of the housing 4 form the interior 49 of the housing 4 when assembled (not shown).

At the upper sides of the two halves 56 and 57 of the housing 4, which face the sharpening rods 24 and 25, the halves 56 and 57 of the housing 4 each carry a guide element 10.

A bearing 58 and 59 are arranged on each of the inner walls 12 of the housing 4. The bearings 58 and 59 serve to hold the trunnions 21 of the sharpening rods 24 against the inner wall 12 of the housing 4.

The one single holding point 42 of the sharpening rods 24 and 25 to the housing 4 is formed by the two bearings 58 and 59 of the trunnion 21 to the housing 4.

The trunnion 21 is integrally connected to the sharpening rod 24.

With its long end, the trunnion 21 of the sharpening rod 24 protrudes through a through hole 15 of the sharpening rod 25.

The longitudinal axis 53 of the trunnion 21 forms the pivot axis 22 of the sharpening rods 24 and 25 relative to the housing 4 of the base 2.

With its through hole 15, the sharpening rod 25 is pushed onto and/or fastened to the trunnion 21 of the sharpening rod 24.

Depending on whether the two sharpening rods 24 and 25 are in a sharpening position 1 or in a rest position 19 relative to each other, the two sharpening rods 24 and 25 are pivoted relative to each other about the pivot axis 22 of the trunnion 21.

FIG. 5 shows in a sequence of images from a-f an operation in which a knife with a blade 60 is guided along inserts 30 of the sharpening rods 24 and 25 for honing the blade 60.

The illustrations a-f of FIG. 5 show the knife sharpening device according to the invention with the base 2 and the guide element 10, which is arranged in front of the sharpening rods 24 and 25 in the front view of the knife sharpening device 11.

The guide element 10 is arranged on the side of the housing 4 of the base 2 on which the sharpening rods 24 and 25 protrude from the interior 49 of the housing 4.

In position a, a blade 60 of a knife is inserted into the slot 6 at the upper end 7 of the slot 6.

In the process, the blade 60 is placed against a sharpening edge 31 of a sharpening insert 30 on each side.

By pressing the blade 60 in against the resistance of the spring 29 (not shown) arranged opposite one another in the housing 4, the sharpening rods 24 and 25 are guided from the rest position 19 (cf. position a) into the sharpening position 1 (illustrations b-f).

To hone the blade 60 of the knife, the blade 60 is guided further towards the lower end 8 of the slot 6 against the force of the springs 29, according to the illustrations b-e.

As the blade 60 moves toward the lower end 8 of the slot 6, the sharpening rods 24 and 25 are spread further apart against the force of the spring 29 (not shown).

In the following, a knife is assumed to have a blade 60 on one of its longitudinal sides.

The blade 60 is inserted into the slot 6 of the knife sharpening device in accordance with the illustrations a to d. With increasing pressure of the blade 60 of the knife against the sharpening rods 24; 25, the blade 60 of the knife is inserted deeper into the slot 6.

In the process, the sharpening rods 24 and 25 are transferred from the rest position 19 to the sharpening position 1 as the blade 60 is further inserted into the slot 6 of the guide element.

For sharpening, the blade 60 is inserted between the sharpening rods 24, 25 with the tip pointing downwards. Subsequently, the blade 60 of the knife is pulled through the knife sharpening device 11 with the tip lowered, from the rear to the front.

Subsequently, the blade 60 is polished. For polishing, the blade 60 is inserted between the sharpening rods 24 and 25 with the tip of the knife facing upwards. Against the pressure of the springs 29 (not shown), the blade 60 of the knife with the tip raised is guided from the rear to the front along the sharpening rods 24 and 25 of the knife sharpening device 11.

In another example, the blade 60 of the knife is a blade 60, with a side serrated edge.

By way of example, and in no way exclusively, it is assumed that the serrated edge is located on the right side of the blade 60 of the knife, as viewed from the back of the knife.

In order to also be able to sharpen and/or polish the serrated edge of the knife, the knife is inserted horizontally between the sharpening rods 24 and 25. At the same time, the blade 60 is pivoted in its horizontal orientation with its tip toward the side of the blade 60 that faces away from the serrated edge. When the blade 60 is guided horizontally along the sharpening rods 24 and 25 from back to front in this position, the side of the blade 60 on which the serrated edge of the knife is located is sharpened and/or polished.

FIG. 6. shows the sharpening insert 30, which is elongated and/or rod-shaped. The sharpening insert 30 is arranged on the surface 37 of the sharpening rod 24; 25 (not shown).

The sharpening insert 30 has a surface 35 that is flush with the surface 37 (not shown) of the sharpening rod 24; 25.

The sharpening insert 30 extends along the longitudinal axis of the sharpening rod 24; 25.

The sharpening rods 24; 25 (not shown) carrying the sharpening inserts 30 are arranged in a V-shape 5 to each other. The sharpening rods 24; 25 can be pivoted in opposite directions about the pivot axis 22.

When the sharpening rods 24; 25 are pivoted about the pivot axis 22, the two sharpening rods 24; 25 with the sharpening inserts 30 arranged thereon move radially in opposite directions.

The sharpening insert 30 comprises at least one surface 35, which is formed as a polishing surface 33. The polishing surface 33 is a plane and flat surface.

The polishing surfaces 33 are arranged on the sharpening inserts 30 in such a way that they move radially in opposite directions to one another when the sharpening rods 24; 25 are pivoted about the pivot axis 22.

To polish the knife, the blade 60 (not shown) is drawn horizontally through the sharpening rods 24; 25. Here, the bevel of the blade slides along the polishing surfaces 33 of the V-shaped sharpening rods 24; 25 on both sides.

When the blade is polished, the previously ground and/or honed bevel of the blade is polished. The blade 60 is additionally compacted and further sharpened by the polishing process.

Transverse to the longitudinal axis 34 of the sharpening insert 30, the surface 35 of the sharpening insert 30 has one end face on each side.

One end face is formed as a sharpening edge 31. The opposite end face forms a honing edge 32.

The sharpening edges 31 are arranged approximately at right angles to the pivot direction of the sharpening rods 24; 25 about the pivot axis 22. The sharpening edges 31 of the sharpening inserts 30 are arranged relative to the plate in such a way that the sharpening edges 31 of the sharpening inserts 30 of both sharpening rods 24; 25 face the plate.

The end face of the sharpening insert 30, which is formed as the sharpening edge 31, has an angle 38 relative to the surface 35 of the sharpening insert 30, which is approximately 88°.

It goes without saying that the end face formed as the sharpening edge 31 can also have a different angle relative to the surface 35 of the sharpening insert 30.

To sharpen the knife, the blade 60 (not shown) is drawn through the sharpening rods 24; 25 with the tip of the blade pointing downward. Here, the bevel of the blade 60 slides along the sharpening edges 31 of the V-shaped sharpening rods 24; 25 on both sides.

As the blade is sharpened, material is removed from the bevel of the blade 60 (not shown) as it is pulled through.

The honing edges 32 are arranged approximately perpendicular to the direction of pivoting of the sharpening rods 24; 25 about the pivot axis 22. The honing edges 32 of the sharpening inserts 30 are arranged relative to the plate such that the honing edges 32 of the sharpening inserts 30 of both sharpening rods 24; 25 face away from the plate.

The honing edge 32 is formed as a curved edge. The honing edge 32 may have a round or oval profiling 39. The honing edge 32 may also have another geometric shape.

The honing edge 32 has a profiling 39 at least in some areas. The profiling 39 has a roughened surface similar to a sandpaper. The profiling 39 comprises irregularities, preferably nubs and/or longitudinally or transversely extending grooves. It may also have any other geometric shape.

The honing edge 32 is made of a material that is harder than the material from which the blade of the knife is made.

To hone the knife, the blade is pulled through the sharpening rods 24; 25 with the tip of the knife pointing upwards. During this process, the bevel of the blade slides along the honing edges 32 of the V-shaped sharpening rods 24; 25 on both sides.

When the blade is honed, the steel chips or material threads remaining on the blade from the grinding process are removed from the blade of the knife.

Any unevenness on the blade remaining after the grinding process is leveled when the blade is pulled off.

FIG. 7 shows the sharpening insert 30 in lateral section according to FIG. 6.

The sharpening insert 30 has the surface 35, which is formed as a polishing surface 33. In the illustration of FIG. 7, the two end faces of the sharpening insert 30 are shown to the right and left of the surface 35 of the sharpening insert 30.

One end face is formed as a sharpening edge 31. The honing edge 32 is arranged on the opposite end face.

The sharpening edge 31 extends at an angle 38 of approximately 88° to the surface 35 of the sharpening insert 30.

The honing edge 32 is shown on the opposite end face. The honing edge 32 shown in FIG. 7 has a profiling 39 that includes grooves 40.

The honing edge 32 is arc-shaped and embedded in the sharpening insert 30.

To fix the sharpening insert 30 to the sharpening rod 24; 25, the sharpening insert 30 has a support 41.

REFERENCE NUMBERS

1 Sharpening position
2 Base
3 Sharpening rod plane
4 Housing
5 V-shaped arrangement of sharpening rods
6 Slot
7 Upper end of slot
8 Lower end of the slot
9 Insertion area of the slot
10 Guide element
11 Knife sharpening device
12 Inner wall of the housing
13 Center line of the slot
14 Outer wall of the housing
15 Through holes of the sharpening rod
16 Partial trunnion
17 Discharge device
18 Loss prevention device
19 Rest position
20 Handle element
21 Trunnion of the sharpening rod
22 Pivot axis; trunnion
23 Side of the sharpening rod facing away from the guide element
24 Sharpening rod with trunnion
25 Sharpening rod
26 Grinding insert
27 Grinding insert
28 Remains free
29 Spring
30 Polishing insert
31 Sharpening edge
32 Honing edge
33 Polishing surface
34 Longitudinal axis of the sharpening insert
35 Surface of the sharpening insert
36 Remains free
37 Surface of the sharpening rod

38 Angle
39 Profiling
40 Grooves
41 Support of the sharpening insert
42 Holding points
V-shape of the holding points
46 Substrate
47 End of the sharpening rod
48 End of the sharpening rod
49 Interior
Arm of the guide element
51 Arm of the guide element
52 Movement limited
53 Longitudinal axis of the trunnion
54 Bar of guide element
Link
56 Half of the housing
57 Half of the housing
58 Bearing
59 Bearing
60 Knife/blade of the knife
61 Fastening device

The invention claimed is:

1. A knife sharpening device comprising:

at least two sharpening rods (24; 25), which are pivotably mounted on a base (2) and which are arranged in a V-shape relative to one another, wherein the V-shaped arrangement of the sharpening rods (24; 25) relative to one another serves for the insertion of a knife;

wherein the sharpening rods (24; 25) each have at least one sharpening insert (30), the sharpening rods (24; 25) are held in their V-shaped arrangement at a predetermined distance from one another in a rest position (19) by the force of a respective associated spring (29); the sharpening rods (24; 25) in a sharpening position (1) with insertion of the knife into the V-shaped arrangement of the sharpening rods (24; 25), can be spread apart against the force of the respective associated spring (29) upon contact of the knife with the sharpening inserts (30); and wherein a single holding point (42) is provided, via which the sharpening rods (24; 25) are held on the base (2), and wherein below the single holding point (42), each of the sharpening rods has an end (47, 48) (42) facing to a bottom end of the base (2), and the respective associated spring (29) connects each end (47, 48) of the sharpening rods (24, 25) to an inner wall surface (12) of a housing (4) of the base (2) below the single holding point (42).

2. The knife sharpening device according to claim 1, characterized in that the sharpening insert (30) is arranged in the region of the upper end (7) of the slot (6), on the sharpening rod (24; 25).

3. The knife sharpening device according to claim 1, characterized in that the sharpening insert (30) is arranged on the sharpening rod (24; 25) in the region of the lower end (8) of the slot (6).

4. The knife sharpening device according to claim 1, characterized in that the sharpening insert (26; 27) is made of one of hard metal, a hardened metal, sintered metal, ceramic, stone, and diamond.

5. The knife sharpening device according to claim 1, characterized in that the base (2) has a fastening device for fastening to a substrate, at an end facing away from the sharpening rods (24; 25).

6. The knife sharpening device according to claim 1, characterized in that a handle element (20) is arranged on at least one side of the base (2).

7. The knife sharpening device according to claim 1, characterized in that a pivot axis (22) is arranged for pivoting the sharpening rods (24; 25) at an angle to the base (2).

8. The knife sharpening device according to claim 1, characterized in that at least one sharpening rod (24; 25) is mounted movably relative to the base (2) via the single holding point (42).

9. The knife sharpening device according to claim 1, characterized in that the sharpening rod (24; 25) is designed as a protective body which protects the sharpening insert (30) from contact by the user and/or from damage and/or from contamination.

10. The knife sharpening device according to claim 1, characterized in that at least one guide element (10) is arranged on at least one side of the base (2), the slot (6) is open at the end of the guide element (10) facing away from the base and closed at the end of the guide element (10) facing toward the base, and the V-shaped arrangement of the sharpening rods (24; 25) and the slot (6) is axially aligned with one another.

11. The knife sharpening device according to claim 10, characterized in that the slot (6) in the guide element (10) has a flared-open end (7).

12. The knife sharpening device according to claim 1, characterized in that the base (2) comprises a housing (4) in which the sharpening rods (24; 25) are held against each other and/or against the base (2) via the single holding point (42).

13. The knife sharpening device according to claim 12, characterized in that at least one discharge device (17) is provided on an inner wall (12) and/or on an outer side of the housing (4) of the base (2).

14. The knife sharpening device according to claim 12, characterized in that a trunnion (21) is arranged in the housing (4), on which at least one sharpening rod (24; 25) is rotatably mounted.

15. The knife sharpening device according to claim 12, characterized in that the housing (4) is designed as a protective body which protects the spring (29) arranged on the respective sharpening rod (24; 25) from contact by the user and/or protects against damage and/or soiling and/or against visibility.

16. The knife sharpening device according to claim 1, characterized in that the spring (29) is a compression spring or a tension spring.

17. The knife sharpening device according to claim 1, characterized in that one spring (29) is arranged on each sharpening rod (24; 25) respectively.

18. The knife sharpening device according to claim 1, characterized in that the spring (29) is a bending spring or a torque spring.

19. The knife sharpening device according to claim 1, characterized in that the restoring force of the spring (29) directed towards a center line (13) of the slot (6) changes during the transition of the sharpening rods (24; 25) from the rest position (19) to the sharpening position (1).

20. The knife sharpening device according to claim 1, characterized in that in the rest position (19) the distance between the two sharpening rods (24; 25) corresponds at most to the width of the slot in the base (2).

21. The knife sharpening device according to claim 1, characterized in that the sharpening insert (30) comprises at least one diamond and/or one ceramic and/or one stone.

22. The knife sharpening device according to claim 1, characterized in that the sharpening insert (30) has regions of different sharpening effect and/or sharpening intensity.

23. The knife sharpening device according to claim 1, characterized in that the sharpening rods (24; 25) and/or the sharpening inserts (30) and/or the base (2) and/or the springs (29) are each designed as exchange modules.

24. The knife sharpening device according to claim 1, characterized in that the sharpening insert (30) comprises at least one of a sharpening edge (31), a honing edge (32), and a polishing surface (33).

25. The knife sharpening device according to claim 24, characterized in that the sharpening edges (31) of the sharpening inserts (30) of the sharpening rods (24; 25) each face each other.

26. The knife sharpening device according to claim 24, characterized in that the honing edges (32) of the sharpening inserts (30) of both sharpening rods (24; 25) face each other.

27. The knife sharpening device according to claim 24, characterized in that the polishing surface (33) is a surface of the sharpening insert (30) which has end faces transverse to the longitudinal axis (34) of the sharpening insert (30), of which one end face is a sharpening edge (31) and the opposite end face is a honing edge (32) respectively.

* * * * *